US006451062B2

(12) United States Patent
Johnson et al.

(10) Patent No.: US 6,451,062 B2
(45) **Date of Patent: *Sep. 17, 2002**

(54) HIDE-CURING ADDITIVE

(75) Inventors: Dana J. Johnson, Broomfield, CO (US); Terry L. McAninch, Westminster, CO (US); Frederick W. Holzhauer, Broomfield, CO (US)

(73) Assignee: Birko Corporation, Henderson, CO (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/159,519

(22) Filed: Sep. 23, 1998

Related U.S. Application Data

(63) Continuation-in-part of application No. 08/588,601, filed on Jan. 18, 1996, now abandoned.

(51) Int. Cl.[7] ..... C14C 1/02

(52) U.S. Cl. ..... 8/94.18; 8/94.15; 252/8.57; 422/28; 422/32; 427/389; 510/275; 510/382; 510/383

(58) Field of Search ..... 252/8.57; 8/94.18, 8/94.15; 422/28, 32; 427/389; 510/382, 383, 275

(56) References Cited

U.S. PATENT DOCUMENTS

| | | | | | |
|---|---|---|---|---|---|
| 4,511,488 | A | * | 4/1985 | Matta | 510/421 |
| 5,330,671 | A | * | 7/1994 | Pullen et al. | 252/88.1 |
| 5,444,078 | A | * | 8/1995 | Yu et al. | 514/372 |

OTHER PUBLICATIONS

Chemical Abstract No. 108:223430, abstract of Czech. Patent No. 243831 (Jul. 1986).*

* cited by examiner

*Primary Examiner*—Anthony J. Green
(74) *Attorney, Agent, or Firm*—Merchant & Gould; Thomas H. Young

(57) ABSTRACT

The invention relates to an improved hide-curing additive comprising an effective biocidal amount of an essential oil and a non-ionic surfactant. The improved additive provides an effective cure for the hides, is environmentally safe and economical.

32 Claims, No Drawings

HIDE-CURING ADDITIVE

CROSS-REFERENCE TO RELATED APPLICATION

This application is a continuation-in-part of U.S. application Ser. No. 08/588,601 filed Jan. 18, 1996, now abandoned.

BACKGROUND OF THE INVENTION

The present invention relates generally to the field of curing hides from a meat-packing plant prior to their shipment to another facility for tanning into leather. In particular, it relates to improved additives for use in hide-curing raceways employed at meat-packing plants and other hide-curing facilities. Hide processing plants cure fresh hides or re-cure previously cured hides. As used herein, "operator" refers to a meat-packer, hide processor or operator of a similar hide-curing facility.

The profitability of a meat-packing plant is greatly affected by the money that the operator receives from various by-products of the meat-packing operation. Typically, the most profitable by-product is from the sale of hides for the production of leather. Because the tanning operation in which the hide is turned into leather is usually conducted at another facility, it is essential for the operator to preserve the value of the hide by curing the hide before shipment to the tanner. The hide must be as clean and free of bacteria as possible in order to avoid decomposition of the hide in the period between removal from the carcass and the tanning operation. That period may be as short as a few days or as long as a year or more.

Decomposition of a hide occurs through the action of bacteria and enzymes, both of these processes being accelerated by heat and moisture. As used herein, references to the deleterious action of bacteria on hides generally refers to the action of both bacteria and enzymes. On a hot summer day, decomposition can begin within four hours of slaughtering and hide removal. Since uncured hides typically contain approximately two-thirds water by weight, the operator should insure that the cured hides are as saturated with salt as possible. This minimizes possible deterioration and reduces the chances of claims by the tanner for insufficient cure.

Perhaps the most significant goal of hide-curing at the meat-packing plant is to reduce the damage that bacteria and other microorganisms can cause to the hide tissue between the time that the hide is flayed from the carcass and the time that it is tanned into leather. Typically the green hide contains contaminants that were present on the animal when it entered the hide processing facility including fresh and decomposed manure and organic matter, such as blood, that are released from the animal during the initial stages of the slaughtering process. All of these organic materials are ideal nutrients for destructive bacteria. If the growth of bacteria is not halted by the curing process, the hide can decompose into a useless, glue-like mass prior to tanning.

The problem of inhibiting microbial growth involves a number of considerations. Obviously, the existing microbial contaminants should be killed or their growth inhibited chemically. In addition, however, it is extremely important to physically remove from the hide the organic material which is an ideal food source for microbes. As mentioned previously, the organic material includes manure, blood and other organic contaminants released in the slaughtering process as well as a not insignificant amount of fat attached to the hide itself. If both considerations are not addressed, any microbes that survive the treatment can propagate in the remaining organic material before tanning is commenced.

The problem of hide-curing has been known for many years. One of the earliest forms of hide-curing was simply to dry the hide in the sun or by artificial means and to physically clean the surface. Although this method was somewhat successful in preventing decomposition of the hide, it was very difficult to re-wet the hide to produce useable leather.

At the present time, meat-packing plants in the United States typically treat green hides in a series of processing steps. These processes are generally described, for example, in U.S. Pat. No. 5,435,808, which is assigned to the assignee of the present invention and is incorporated by reference herein. As described therein, a typical plant may initially treat the hide by cooling it and removing flesh. The preliminary procedures may vary from plant to plant. However, treatment of the hide with a brine is an essential step common to hide-curing processes at meat-packing plants in the United States.

The brine curing is typically conducted in a "raceway." Regardless of whether the hide has been fleshed or not, the hide sent to the raceway still contains a layer of fat and organic material, as well as bacteria. The purpose of the hide-curing raceway is to physically remove the remaining fat and organic material and to chemically kill or inhibit the growth of bacteria so that the cured hide will not decompose.

A typical hide raceway is an oval shaped structure filled with brine. These structures are large, containing tens of thousands of gallons of brine and hundreds of hides. Paddle wheels placed on each side of the raceway circulate the hides in the brine to maximize contact between the hides and the brine and the removal of contaminants. The brine is a saturated aqueous solution of salt, usually sodium chloride. Treatment is normally affected for 12 to 72 hours, although the most typical time is about 16 hours.

The brine is an excellent inhibitor of bacterial growth, but does not necessarily kill the bacteria. During the curing it is important to have the hide absorb as much salt as possible to inhibit the future growth of bacteria during storage and shipment. Typically, the hide processor monitors the amount of salt absorbed by the hides by measuring the diminution of the salt remaining in the brine with a salometer. When the salt is absorbed, it replaces a significant portion of the water in the hides and saturates the remainder. As much as two gallons of water are released from each hide. Excess brine is permitted to overflow. The operator of the curing raceway must monitor the salinity of the brine carefully to ensure that the brine remains saturated. If the brine does not remain saturated, the hides will not be saturated with salt and may decompose later.

Because of the foregoing qualities and the fact that it is relatively inexpensive, sodium chloride is the primary hide-curing agent. Potassium chloride can also be used and, indeed, has certain advantages over sodium chloride. However, potassium chloride is not used extensively because of its price. Other hide preservatives and cure accelerators are sometimes added to the brine, but the principal agent is salt. As used herein, "salt" refers to potassium chloride, sodium chloride or mixtures thereof.

The cured hides are removed from the brine and are then treated in a wringer or by other means to reduce moisture for the reasons previously noted. A typical hide will contain approximately 48% water by weight at this stage of processing. The hides are then graded, bundled and palletized for shipment. Sometimes they are salted on the flesh side to prevent decomposition before being bundled and palletized. Although brine curing has been utilized since the 1950's, the process does have certain deficiencies. Among other things, the chemicals used in hide-curing are not environmentally friendly. Increasing environmental concerns significantly limit the disposal of the salt-containing brine. In addition, many of the materials that are added to the hide raceway to improve curing present similar considerations. Some of these materials are expensive, disposal is restricted because of their toxicity, and they are not biodegradable.

Efforts have been made to clean and recycle the brine to minimize the quantity of material to be disposed. Typically, this is done by filtering out some of the solids and then concentrating the remainder by forcing off the excess water in a dehydrator. Unfortunately, organic matter that is recycled back into the raceways acts as food for bacteria. Generally speaking, organic levels in brine exceeding 1% by weight can create high bacteria counts. The halophilic organisms that create the discolorations on the flesh side of the hide during storage are called "red heat." The red heat organisms require high salt concentrations to survive, and thrive in warm, dark, moist environments. If the salt slurry from the dehydrator is added back into the raceway while still hot, the temperature of the raceway will rise, thus favoring red heat growth. Warm brine may help cures in the winter, but in summer it causes red heat to flourish. With the use of dehydrators, red heat has been observed developing on hides in only two weeks time; previously it would have taken weeks or even months for the red discoloration to appear. If the hides develop "red heat" or are otherwise improperly cured, the tanner may file a claim against the operator for diminished value or may reject the hides entirely resulting in loss of revenue to the meat-packer.

OBJECTS OF THE INVENTION

It is an object of the invention to provide an economical hide-curing additive that prevents the growth of bacteria in the hide raceway and on the hides, is environmentally safe, and is biodegradable.

These and other objects and advantages of the present invention can be achieved utilizing the processes and compositions described herein.

SUMMARY OF THE INVENTION

It has now been found that the addition of a solution containing one or more essential oils with antimicrobial properties provides an improved hide-curing additive. In particular, it has been found that the addition of a solution containing one or more non-ionic surfactants, at least one essential oil with antimicrobial properties in a solvent a base provides an improved hide-curing additive.

In general, the composition should contain:

| | |
|---|---|
| Non-ionic surfactant(s) | 10–30% by wt. |
| Essential oil | 7–40% |
| Diluent | balance |

The ingredients may be added pre-mixed to or can be added individually to the hide-curing raceway.

The hide-curing additives of the present invention meet the foregoing objects. They are environmentally safe. A number of the ingredients are approved by the U.S. Agriculture Department for incidental contact with food. They are biodegradable. Pine oil, camphor and other essential oils have microbicidal properties which kill or inhibit the growth of bacteria in the raceway and on the hides. The surfactants in the additive improve the absorption of salt in the hides further enhancing the curing effect of the brine. Other advantages are described herein.

DETAILED DESCRIPTION OF THE INVENTION AND THE PREFERRED EMBODIMENT

It has now been found that the addition of a solution containing one or more essential oils with antimicrobial properties provides an improved hide-curing additive. In particular, it has been found that the addition of a solution containing one or more non-ionic surfactants, at least one essential oil with antimicrobial properties in a solvent base provides an improved hide-curing additive.

In general, the composition should contain:

| | |
|---|---|
| Non-ionic surfactant(s) | 10–30% by wt. |
| Essential oil | 7–40% |
| Diluent | balance |

In a particularly preferred embodiment, the hide-curing additive contains:

| | |
|---|---|
| LPA 210 | 70.0% by wt. |
| T-Det N-4 | 7.0% |
| Pine oil | 5.0% |
| T-Det N-9.5 | 8.0% |
| Camphor | 10.0% |

These ingredients may be added pre-mixed to the hide raceway or can be added individually.

Although the preferred embodiment uses a combination of pine oil and camphor as the essential oils, other essential oils having antimicrobial properties may be used. These include, but are not limited to, orange, citronella, d-limonene, dipentene or eugenol. As essential oils, pine oil and camphor are particularly useful for hide-curing and preservation due to their anti-microbial properties and ability to deodorize. These essential oils provide a characteristic but pleasant odor that mask some of the more unpleasant odors in the hide house.

The essential oil chosen may be used alone or in combination with other essential oils having antimicrobial properties. The compositions of the present invention can also include or be used in conjunction with other compatible biocides.

A solvent for the essential oils is used as a carrier. The principal criteria in selecting the solvent is it's ability to deliver the essential oils and surfactant to the hide, rather than dispersing it throughout the aqueous brine in the hide raceway. Accordingly, a non-aqueous solvent is used. Preferred carriers include aliphatic solvents, such as hydrogenated petroleum distillates, particularly those of a food grade quality. Aliphatic solvents with flash points ≧140 deg. F. are preferred. Petroleum ether is another solvent that could be used in accordance with this invention. Other suitable solvents include pentane, hexane, cyclohexane, petroleum naptha, heptane, VM&P naptha, 90 solvent (i.e., an aliphatic solvent with a flash point of 90 deg. F.), mineral spirits, odorless mineral spirits, low odor base solvent, 140 solvent (i.e., an aliphatic solvent with a flash point of 140 deg. F.) and mineral seal oil. Gasoline and diesel fuel, also aliphatic solvents, are undesirable for commercial purposes because of their high vapor pressure, low flash point and water pollution concerns. All of the foregoing non-aqueous solvents form a dispersion containing the essential oils and surfactant on the surface of the brine in the hide raceway, therefore, bringing those ingredients into preferential contact with the hides. In contrast, an aqueous solvent would disperse the additive throughout the brine, significantly adding to the cost of application.

LPA-210 is a preferred solvent. It is a paraffinic/napthenic solvent made by Vista Chemical of Houston, Tex. It is approved by the U.S. Food and Drug Administration for use in applications where it may have incidental contact with food. It has a flash point of more than 201° F., which means that it is "noncombustible" under Department of Transportation regulations. Also, it is biodegradable.

The non-ionic surfactants are used both to assist in dispersing the essential oil into the raceway brine and to aid in absorption of the salt by the hides. When the ingredients are pre-mixed, the surfactant also assists in coupling the essential oils into the formula. The surfactants should be used in amounts which accomplish these purposes. Suitable surfactants include primary and secondary alcohol ethoxylates, nonylphenol ethoxylates, and block polymer surfactants. Particularly preferred are T-Det N4 and T-Det N-9.5 which are sold under those trade marks by Harcros Chemicals, Inc., Kansas City, Kans. These products are nonylphenoxypolyethoxyethanols having moles of ethoxylation of 4 and 9.5, respectively. Nonylphenoxypolyethoxyethanols having other moles of ethoxylation can be used alone or in combination.

It is possible to overwet a hide. If a disproportionate amount of lower molecular weight surfactant is used, the formulation will not disperse uniformly into the brine. This will result in uneven cures and may cause other problems to the hide. Use of excess surfactant or wetting agent can result in absorption by the hide of undesirable materials from the brine, such as, manure and other organic material. In general, wetting agents and surfactants should be used in amounts that do not result in absorption of materials through the exterior side of the hide. This amount may vary depending on the surfactant, wetting agent and essential oil that is used.

Generally, the hide-curing additive of the present invention is added to the raceway after the hides have been introduced and curing has begun. An advantage of the present invention is that the preferred composition is highly concentrated, i.e., it is necessary to use only about one-third (i.e., ⅓) gallon per 100 fleshed hides or one-half (i.e., ½) gallon per 100 unfleshed hides.

The process of the present invention has a number of advantages. First, it is much safer to use than existing additives that are flammable and are difficult to dispose of. The ingredients of the present hide-curing additives do not have an Environmental Protection Agency, "RQ," i.e., reportable quantity, which mandates reporting to government authorities in the event that a spill or release occurs in excess of the designated quantity. Many of the ingredients may be used in food processing plants, an indication of their safety; the compositions are biodegradable. In addition, the invention provides a more efficient way to cure hides in that salt absorption by the hides is maximized. This increases the storage life of the hides, minimizes the possibility of "red heat," and ensures acceptability of the hides by tanners. The hide-curing additives of the present invention deodorize and provide a clean, medicinal smell. Hides cured using the additives of the present invention have a supple "handle." Fold marks are removed from previously cured and bundled hides.

Modifications may be made in the compositions of the present invention without significantly affecting the process results. For example, non-ionic fluoro surfactants, such as FC 431 manufactured by 3M Specialty Chemicals Division of 3M, St. Paul, Minn., may be used to obtain additional wetting. Biocides such as chlorinated or quaternary ammonium disinfectants which are compatible with the other ingredients may also be used.

The novel composition and processes of our invention are illustrated by the following examples:

EXAMPLES

Common Test Parameters:

The following composition was used in curing hides in each of the following examples:

| | |
|---|---|
| LPA 210 | 70.0% by wt. |
| T-Det N-4 | 7.0% |
| Pine Oil | 5.0% |
| T-Det N-9.5 | 8.0% |
| Camphor | 10.0% |

The pine oil used was Unipine 85 manufactured by Bush Boake Allen, Inc. of Jacksonville, Fla. and has an E.P.A. registration as a germicide. The camphor was a synthetic camphor supplied by Koch Industries, Bennett, Colo.

As used in the examples, the following terms reference qualities of a cured hide as indicated:

"Moisture %" means the amount of water in the hide after curing. Traditionally, tanners look for about 45%.

"Ash to Hide" refers to the amount of salt in the hide (after removing the water).

"Wet ash" refers to the amount of salt in the hide (without removing the water).

"Brine Saturation" means the percentage of salt to residual water left in the hide.

Example 1

The foregoing hide-curing additive was used to improve the treatment of hides in a commercial meat-packing plant. The plant had two raceways (i.e., A and B) each of which was used to cure approximately 800 hides in a brine solution of sodium chloride. The hides were unfleshed. About 4 gallons of the hide-curing additive (i.e., one-half gallon per 100 hides) were added to raceway A after all of the hides were in the raceway. In raceway B, the same amount of Syntalazene was used. Syntalazene is a commercial hide-curing additive available from the Birko Corporation, Henderson, Colo.

Hides cured with the additive of the present invention and a commercial additive of the prior art had the qualities indicated in Table I.

TABLE I

| Additive | Moisture % | Ash to Hide Substance Ratio % | Wet Ash % | Brine Saturation % |
|---|---|---|---|---|
| Present Invention (raceway A) | 50.60 | 28.34 | 14.00 | 77.09 |
| Prior Art (raceway B) | 47.42 | 23.56 | 12.39 | 72.76 |

These results indicate that the additive of the present invention cured hides as well as an existing commercial product. In addition, the hides exhibited a "clean" smell, had a good "handle," i.e., were supple, thereby making the hides easier to fold and bundle. The hides were tanned, i.e., produced into leather, without any problems.

Example 2

Various modifications of the standard formula previously identified were tested on successive days in a commercial meat-packing plant having several raceways. The compositions utilized and the cured qualities of the resulting hides are demonstrated in Table II. The results are compared to a control representing various measurements taken at the same plant on hides produced using Syntalazene during the previous eighteen months.

TABLE II

| Hide | Additive | Moisture % | Dry Ash % | Wet Ash % | Brine Saturation % |
|---|---|---|---|---|---|
| Cows | Standard | 48.8 | 30.8 | 15.2 | 90.2 |
| Cows | 1 | 48.6 | 33.8 | 17.3 | 99.1 |
| Cows | 2 | 46.6 | 29.8 | 15.8 | 94.7 |
| Fats | 3 | 47.2 | 30 | 15.8 | 93.5 |
| Fats | 4 | 43 | 27 | 15.3 | 98.8 |
| Fats | 5 | 45.8 | 32.1 | 17.5 | 106 |
| Control | Syntalazene | 43.6 | 23.4 | 13.2 | 84.4 |

1 = Standard plus 10 oz. D limonene.
2 = Standard plus 1 ml FC 431.
3 = Standard plus 12 oz. additional pine oil.
4 = Standard plus 4 oz. D limonene.
5 = Standard plus 1 ml. FC 431.
Each of the numbers in Table II represent the average of at least 4 measurements. "Fats" refers to fat cattle or steers.

The results of this test indicate the efficacy of the invention. The cures were very satisfactory as demonstrated by the ash and saturation figures. Furthermore, there were certain intangible qualities such as odor control which are difficult to measure quantitatively but are important to worker morale.

The description and examples set forth herein are intended to illustrate representative embodiments of the invention. The claims which follow are not intended to be limited to the specific disclosed embodiments. The invention is susceptible to modification, variation and change without departing from the proper scope or fair meaning of the following claims.

We claim:

1. A hide-curing additive comprising:

| | |
|---|---|
| Essential oil | 7–40% by wt. |
| Non-ionic surfactant | 10–30% |
| Diluent | balance |

wherein the diluent is a non-aqueous solvent.

2. The hide-curing additive of claim 1, wherein the essential oil is selected from the group consisting of pine oil, camphor, orange, citronella, d-limonene, dipentene, and eugenol.

3. The hide-curing additive of claim 1, wherein the essential oil is selected from the group consisting of pine oil and camphor.

4. The hide-curing additive of claim 1, wherein the surfactant is selected from the group consisting of primary and secondary alcohol ethoxylates, nonylphenol ethoxylates, and block polymer surfactants.

5. The hide-curing additive of claim 1, wherein the surfactant is a nonylphenoxypolyethoxyethanol.

6. The hide-curing additive of claim 1, wherein the diluent is an aliphatic solvent.

7. The hide-curing additive of claim 1, wherein the aliphatic solvent has a flash point of at least 140° F.

8. The hide-curing additive of claim 1, wherein the diluent is an hydrogenated petroleum distillate.

9. The hide-curing additive of claim 1, wherein the diluent is at least one member selected from the group consisting of petroleum ether, pentane, hexane, cyclohexane, petroleum naphtha, heptane, VM&P naphtha, mineral spirits, and mineral seal oil.

10. The hide-curing additive of claim 2, wherein the surfactant is selected from the group consisting of primary and secondary alcohol ethoxylates, nonylphenol ethoxylates, and block polymer surfactants.

11. The hide-curing additive of claim 2, wherein the surfactant is a nonylphenoxypolyethoxyethanol.

12. The hide-curing additive of claim 2, wherein the surfactant is selected from the group consisting of a nonylphenoxypolyethoxyethanol having 4 or 9.5 moles of ethoxylation.

13. The hide-curing additive of claim 3, wherein the surfactant is selected from the group consisting of primary and secondary alcohol ethoxylates, nonylphenol ethoxylates, and block polymer surfactants.

14. The hide-curing additive of claim 3, wherein the surfactant is a nonylphenoxypolyethoxyethanol.

15. The hide-curing additive of claim 3, wherein the surfactant is selected from the group consisting of a nonylphenoxypolyethoxyethanol having 4 or 9.5 moles of ethoxylation.

16. A hide-curing additive comprising:

| | |
|---|---|
| Pine Oil | 5.0% by wt. |
| Camphor | 10.0% |
| [T-Det N-9.5] nonylphenoxypolyethoxyethanol having 9.5 moles of ethoxylation | 8.0% |
| [T-Det N-4] nonylphenoxypolyethoxyethanol having 4 moles of ethoxylation | 7.0% |
| [LPA 210] a paraffinic/napthenic solvent having a flash point of more than 201° F. | 70.0% |

17. An improved method of curing hides wherein the hides are contacted with a salt solution, comprising the addition of a hide-curing additive comprising:

| | |
|---|---|
| Essential oil | 7–40% by wt. |
| Non-ionic surfactant | 10–30% by wt. |
| Diluent | balance |

wherein the diluent is a non-aqueous solvent.

18. The method of claim 17, wherein the essential oil is selected from the group consisting of pine oil, camphor, orange, citronella, d-limonene, dipentene, and eugenol.

19. The method of claim 17, wherein the essential oil is selected from the group consisting of pine oil and camphor.

20. The method of claim 17, wherein the surfactant is selected from the group consisting of primary and secondary alcohol ethoxylates, nonylphenol ethoxylates, and block polymer surfactants.

21. The method of claim 17, wherein the surfactant is a nonylphenoxypolyethoxyethanol.

22. The method of claim 17, wherein the diluent is an aliphatic solvent.

23. The method of claim 17, wherein the aliphatic solvent has a flash point of at least 140° F.

24. The method of claim 17, wherein the diluent is an hydrogenated petroleum distillate.

25. The method of claim 17, wherein the diluent is at least one member selected from the group consisting of petroleum ether, pentane, hexane, cyclohexane, petroleum naphtha, heptane, VM&P naphtha, mineral spirits, and mineral seal oil.

26. The method of claim 18, wherein the surfactant is selected from the group consisting of primary and secondary alcohol ethoxylates, nonylphenol ethoxylates, and block polymer surfactants.

27. The method of claim 18, wherein the surfactant is a nonylphenoxypolyethoxyethanol.

28. The method of claim 18, wherein the surfactant is selected from the group consisting of a nonylphenoxypolyethoxyethanol having 4 or 9.5 moles of ethoxylation.

29. The method of claim 19, wherein the surfactant is selected from the group consisting of primary and secondary alcohol ethoxylates, nonylphenol ethoxylates, and block polymer surfactants.

30. The method of claim 19, wherein the surfactant is a nonylphenoxypolyethoxyethanol.

31. The method of claim 19, wherein the surfactant is selected from the group consisting of a nonylphenoxypolyethoxyethanol having 4 or 9.5 moles of ethoxylation.

32. An improved method of curing hides wherein the hides are contacted with a salt solution comprising the addition of a hide-curing additive comprising:

| | |
|---|---|
| Pine Oil | 5.0% by wt. |
| Camphor | |
| [T-Det N-9.5] | |
| nonylphenoxypolyethoxyethanol having 9.5 moles of ethoxylation | 8.0% |
| [T-Det N-4] | |
| nonylphenoxypolyethoxyethanol having 4 moles of ethoxylation | 7.0% |
| [LPA 210] | |
| a paraffinic/napthenic solvent having a flash point of more than 201° F. | 70.0% |

* * * * *